US007624869B2

(12) United States Patent
Primer

(10) Patent No.: US 7,624,869 B2
(45) Date of Patent: Dec. 1, 2009

(54) PACKAGE FOR WOUND CARE PRODUCTS

(75) Inventor: Jonathan S. Primer, Highland Park, IL (US)

(73) Assignee: Medline Industries, Inc., Mundelein, IL (US)

( * ) Notice: Subject to any disclaimer, the term of this patent is extended or adjusted under 35 U.S.C. 154(b) by 190 days.

(21) Appl. No.: 11/804,438

(22) Filed: May 17, 2007

(65) Prior Publication Data

US 2008/0283433 A1 Nov. 20, 2008

(51) Int. Cl.
*A61B 19/02* (2006.01)
*G09F 3/10* (2006.01)

(52) U.S. Cl. ..... 206/440; 206/232; 206/828; 40/638; 283/81

(58) Field of Classification Search ..... 206/232, 206/440, 570, 828, 459.5; 283/900, 81, 101, 283/105, 106, 61, 62, 63.1; 40/306, 310, 40/638; 281/2, 3.1, 5, 15.1, 51
See application file for complete search history.

(56) References Cited

U.S. PATENT DOCUMENTS

| | | | | | |
|---|---|---|---|---|---|
| 829,923 | A | * | 8/1906 | Lee | 206/440 |
| 2,291,149 | A | * | 7/1942 | Connor | 206/440 |
| 3,017,990 | A | * | 1/1962 | Singerman | 206/440 |
| 3,958,750 | A | | 5/1976 | Prybeck | 229/56 |
| 4,215,879 | A | | 8/1980 | Blum | 283/21 |
| 4,666,040 | A | * | 5/1987 | Murata | 206/441 |
| 4,689,099 | A | | 8/1987 | Ito et al. | 156/69 |
| 4,752,087 | A | | 6/1988 | Weisbach | 283/67 |
| 4,921,277 | A | | 5/1990 | McDonough | 283/81 |
| 4,991,878 | A | * | 2/1991 | Cowan et al. | 283/81 |
| 5,242,055 | A | | 9/1993 | Pora | 206/532 |
| 5,433,317 | A | * | 7/1995 | Roser | 206/232 |
| 5,692,640 | A | | 12/1997 | Caulfield et al. | 221/70 |
| 5,749,842 | A | | 5/1998 | Cheong et al. | 602/41 |
| 5,852,590 | A | | 12/1998 | de la Huerga | 368/10 |
| 6,068,115 | A | * | 5/2000 | Boulton | 206/232 |
| 6,186,325 | B1 | | 2/2001 | Schmidt et al. | 206/263 |
| 6,235,964 | B1 | | 5/2001 | Kadash et al. | 602/41 |
| 6,273,260 | B1 | | 8/2001 | ColDepietro et al. | 206/532 |
| 6,343,695 | B1 | | 2/2002 | Petrick et al. | 206/534 |
| 6,357,589 | B2 | | 3/2002 | Schmidt et al. | 206/364 |

(Continued)

FOREIGN PATENT DOCUMENTS

WO WO 2006/031162 A1 3/2006

OTHER PUBLICATIONS

IDS Packaging article entitled "Retail Packaging—Folding Cartons And Corrugated" (2 pages) (Printed on Jan. 24, 2007 from www.idspackaging.com website).

(Continued)

*Primary Examiner*—Jila M Mohandesi
*Assistant Examiner*—Sharon M Prange
(74) *Attorney, Agent, or Firm*—Nixon Peabody LLP

(57) ABSTRACT

A wound care package includes a wound care product for treating a severe wound and an individual package in which the wound dressing is stored prior to usage. The wound care package further includes a booklet-type label affixed to an exterior surface of the individual package, the booklet-type label including on its interior surface severe wound treatment information.

3 Claims, 5 Drawing Sheets

U.S. PATENT DOCUMENTS

| | | | | |
|---|---|---|---|---|
| 6,629,602 | B1 | 10/2003 | Heyman | 206/438 |
| 6,955,002 | B2 | 10/2005 | Sandel et al. | 40/638 |
| 6,957,738 | B2 * | 10/2005 | Hammond | 206/570 |
| 6,998,511 | B2 * | 2/2006 | Worthley | 602/57 |
| 7,205,449 | B2 * | 4/2007 | Levin | 602/58 |
| 7,329,417 | B2 * | 2/2008 | Nielsen | 424/443 |
| 2001/0037954 | A1 | 11/2001 | Schmidt et al. | 206/364 |
| 2002/0056989 | A1 | 5/2002 | Lewis-Leander | 283/81 |
| 2003/0183547 | A1 | 10/2003 | Heyman | 206/439 |
| 2005/0126950 | A1 | 6/2005 | Kaufman | 206/534 |
| 2005/0268505 | A1 | 12/2005 | Sandel et al. | 40/324 |
| 2006/0006867 | A1 | 1/2006 | Van Den Brink | 324/318 |
| 2006/0097516 | A1 | 5/2006 | Kozlowski et al. | 283/117 |
| 2006/0163869 | A1 | 7/2006 | Adler et al. | 283/81 |
| 2007/0029788 | A1 | 2/2007 | Adler | 283/81 |
| 2007/0034538 | A1 | 2/2007 | Landis | 206/438 |

OTHER PUBLICATIONS

IDS Packaging article entitled "Carton Printing" (2 pages) (Printed on Jan. 24, 2007 from www.idspackaging.com website).

IDS Packaging article entitled "Blister Packaging" (2 pages) (Printed on Jan. 24, 2007 from www.idspackaging.com website).

IDS Packaging article entitled "Batch Inclusion/Low Melt Bags" (2 pages) (Printed on Jan. 24, 2007 from www.idspackaging.com website).

IDS Packaging article entitled "Pouch Material" (1 page) (Printed on Jan. 24, 2007 from www.idspackaging.com website).

IDS Packaging article entitled "2 and 4 Mil Whiteblock Poly Bags" (1 page) (Printed on Jan. 24, 2007 from www.idspackaging.com website).

IDS Packaging article entitled "Drug-Pak® Blister Backing, Safety-Pak®" (1 page) (Printed on Jan. 24, 2007 from www.idspackaging.com website).

IDS Packaging article entitled "Flexible Packaging Materials for Lawn, Garden, Pet Food, Bird Seed, Confectionary, Food and Retort Packaging" (5 pages) (Printed on Jan. 24, 2007 from www.idspackaging.com website).

IDS Packaging article entitled "2 and 4 Mil Whiteblock Poly Bags" (2 pages) (Printed on Jan. 24, 2007 from www.idspackaging.com website).

* cited by examiner

PACKAGE FOR WOUND CARE PRODUCTS

FIELD OF THE INVENTION

The present invention relates generally to wound care products. More particularly, the present invention relates to a package for a wound care product that includes information for treating a severe wound.

BACKGROUND OF THE INVENTION

A wound is a break in the skin that is caused by a cut or a scrape. To minimize the possibility of scarring and/or infection, wound care treatment should be performed based on several factors, including a patient's age, wound size, wound location, wound severity, etc. The wound treatment is based on the type of wound (i.e., "light" or "severe") and can vary based on one or more of the factors listed above. For example, a light wound generally requires few dressing changes and, as such, it may only require a plain cloth bandage, e.g., BAND AID® adhesive bandages, for keeping the wound clean during the healing process. In general, light wounds are the types of wounds that do not require special treatment care, e.g., lights scrapes or cuts.

In contrast to light wounds, severe wounds require special treatment care. Treatment of severe wounds is generally performed in accordance with specific treatment directions that are generally customized to each individual patient based on one or more of the factors listed above. Because of the complexity of the severe wounds and the varying individual patient factors, treatment of severe wounds is not simple or straightforward. Although treatment of a light wound may be as simple as applying a single plain cloth bandage to the wound, treatment of a severe wound requires appropriate treatment that seeks to address problems that cause the severe wound. Thus, the treatment of a severe wound requires proper instructions, which may change during different stages of treatment, and proper application of the instructions, which must be followed precisely.

Treatment of severe wounds, including chronic wounds, is generally directed to healing through secondary intention, which refers to the wound closing by contraction and reepithelialization. For example, if there are post-operative complications such as infections, wound dehiscence, excessive scar, or excessive drainage, the wounds would heal by secondary intention. In other words, the wound is allowed to heal by forming granulation tissue from a bottom of the wound outward. In contrast, primary wound healing (or healing by first intention) occurs when the wound is not contaminated, dead spaces are closed, tissue is handled gently, hemostasis is achieved, and the tissues are approximated accurately.

One type of severe wound is a chronic wound, such as a pressure sore, a diabetic foot ulcer, and an arterial ulcer. Chronic wounds have been referred to as wounds that do not heal in an orderly set of stages and in a predictable amount of time. In fact, chronic wounds may take years to heal or may never heal. When treating chronic wounds, the person performing the treatment generally addresses the cause of the chronic wounds, including ischemia, bacterial load, and imbalance of proteases. Some methods used to ameliorate the cause of chronic wounds include antibiotic and antibacterial use, debridement, irrigation, vacuum-assisted closure, warming, oxygenation, moist wound healing, removing mechanical stress, and adding cells or other materials to secrete or enhance levels of healing factors.

Regardless of whether the person performing the treatment is a wound care professional (e.g., doctor, nurse, etc.) or an end user (e.g., wounded person, family, etc.), that person must follow precise treatment directions and use any required wound care products for severe wounds properly. For example, the person performing the treatment on a sever wound must know how to use and apply wound care products such as wound dressings, gauze dressings, and bandages. The problem is that often the treating person lacks any knowledge of how to open the wound care product, how to use it properly, how to remove it properly, etc.

For example, when using a wound dressing impregnated with a variety of substances, such as hydrogels, saline, antimicrobial agents, and other substances, the treating person often does not know whether the wound dressing is appropriate for use for a specific type of severe wound in a specific patient. Accordingly, one problem associated with some impregnated wound dressings is that they fail to provide usage information, such as usage directions in a suitable manner for use by the treating person when treating the severe wound.

Many wound care products are individually packaged as single-use wound care items, which, in turn, are packaged in containers housing a plurality of the single-use wound care items. Although printed information, such as usage information or directions, may sometimes be provided on the container, the single-use wound care items lack similar printed information or any printed information. Often, the container is discarded and the treating person is left with single-use wound care items that, in many instances, lack any kind of printed information, such as usage information or directions. In fact, especially in a health treatment facility (e.g., a hospital), the container is likely to be inadvertently misplaced or discarded based on constant change of personnel, patients, and care. If the container is unavailable, the printed information generally available on the container is also unavailable to the treating person. Thus, the treating person may be forced to apply a wound dressing without the benefit of the printed information, such as usage information or directions. Likely, the treating person may use blank (information-less) items, and, therefore, increase the potential for wound care errors and waste caused by an improper initial application and the need for a re-application of the wound care product. Alternatively, if the treating person chooses to err on the safe side, he or she will likely discard any unused wound care products and, accordingly, increase financial waste associated with the health care costs.

According to some statistics, wound care financial waste translates into high medical costs—financial waste accounts for 25-40% of all hospital costs (e.g., a total medical error cost of $9.3 billion, with an increased cost to hospitals of $4,700 per admission). Wound care errors also translate into fatal results—approximately 98,000 people die in any given year from medical errors that occur in hospitals (deaths due to medical error exceed suicide, which is the eighth leading cause of death). Furthermore, the statistics show that 1 in every 20 patients contract an infection in the hospital and that 40 to 50 patient injuries per 100 hospital admissions are injured by hospital care. Thus, improved treatment care of severe wounds can reduce hospital infections and financial waste.

Another problem associated with some wound care products is that they fail to provide efficient means for correlating relevant wound information to a respective wound patient. After dressing a wound, the treating person must generally rely on memory or on clear communications to remember, for example, when to change a wound dressing. In health care settings, overworked and/or inexperienced professionals and confusion created by frequent medical procedures on the patient are some exemplary causes of human error when treating a wound. Thus, the potential for improper wound treatment is high based on the high potential for human error. For example, miscommunication between professionals regarding changing a wound dressing can result in a wound dressing being changed too soon or too late. In turn, the improper changing of wound dressings can delay the healing process (e.g., if the wound dressing is changed too soon) and/or can increase the potential for infection (e.g., if the wound dressing is changed too late). In another example, a wound care professional may forget any special conditions associated with a particular patient. Applying the wrong wound dressing can have serious adverse, and potentially deadly, effects on the patient.

Therefore, a need exists for a wound care product that includes printed information for treatment of a severe wound, such as usage information or directions on an individual single-use wound care item, and/or that provides efficient means for correlating relevant severe wound information to a respective wound patient. The present invention is directed to satisfying one or more of these needs and solving other problems.

SUMMARY OF THE INVENTION

According to one implementation, a wound care package includes a wound care product for treating a severe wound and an individual package in which the wound dressing is stored prior to usage. The wound care package further includes a booklet-type label affixed to an exterior surface of the individual package, the booklet-type label including on its interior surface severe wound treatment information.

According to another implementation, a method for providing a severe wound care package includes inserting a wound care product into an individual package and attaching a booklet-type label to an exterior surface of the individual package. The method further includes providing a set of usage directions for treating a severe wound. The set of usage directions is located on an interior surface of the booklet-type label.

According to a further implementation, a wound dressing package for treatment of a severe wound includes a container, a plurality of individual pouches located inside the container, and a wound dressing located inside each of the plurality of individual pouches. The wound dressing package further includes a main label attached to an exterior surface of each of the plurality of individual pouches. The main label includes a top sheet and a bottom sheet connected to each other along one edge, the main label including severe wound treatment information on an interior surface of the bottom sheet.

The above summary of the present invention is not intended to represent each embodiment or every aspect of the present invention. The detailed description and Figures will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
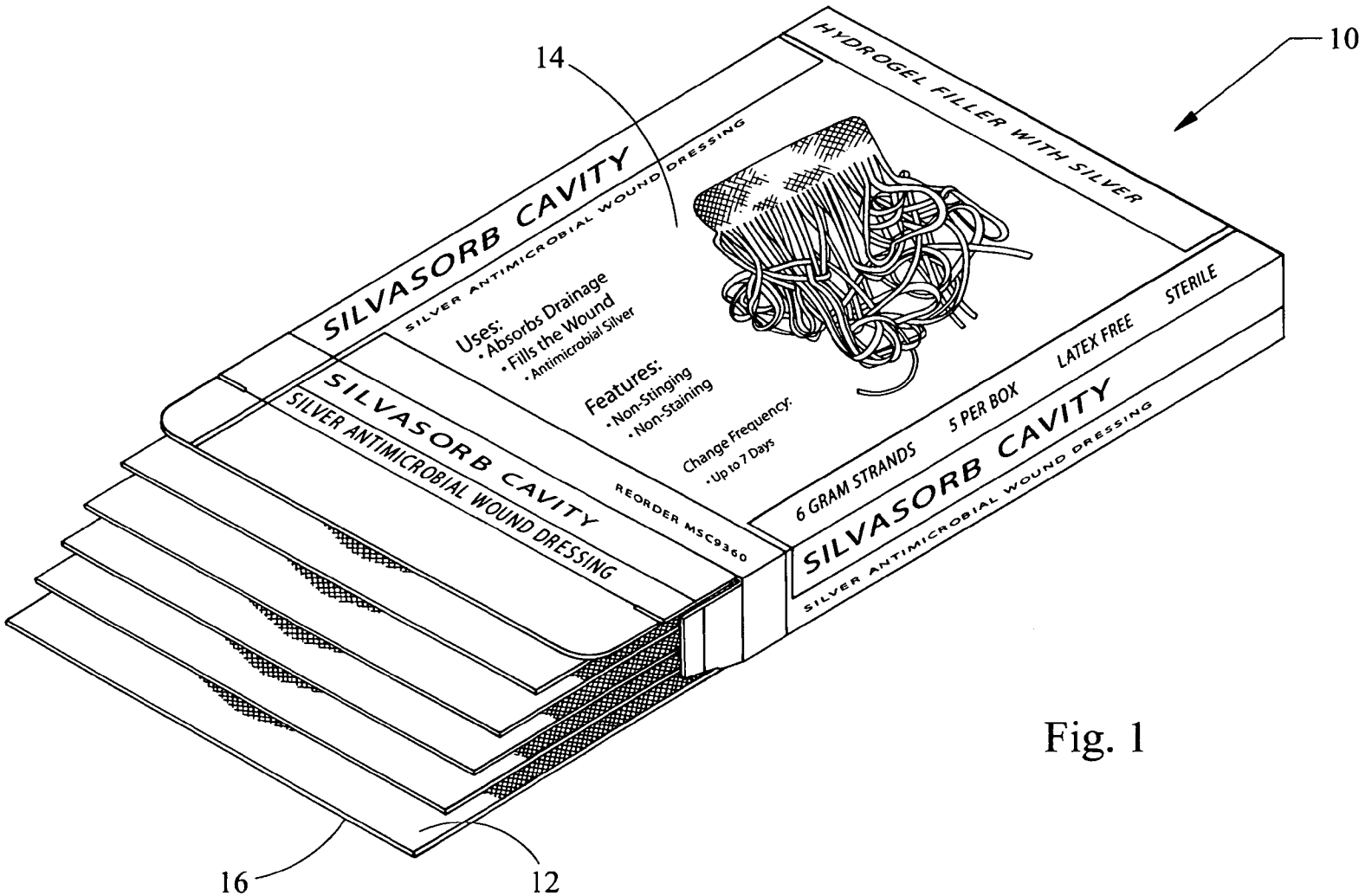
FIG. 1 illustrates a perspective view of a wound dressing box having a plurality of individual wound dressing pouches.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention.

DESCRIPTION OF ILLUSTRATIVE EMBODIMENTS

Referring to FIG. 1, a plurality of wound care products are packaged together in a single package for treatment of severe wounds. Each wound care product is a single-use wound care item that is inserted into a corresponding individual package. For example, one type of wound care products for treatment of severe wounds is a wound dressing. According to one implementation, a package for one or more wound dressings includes a container in the shape of a box 10 and five wound dressings individually packaged in respective pouches 12. In alternative implementations, the container can be any type, size, or shape (e.g., a circular box, a rectangular bag, etc.), can be any material, and can include any number of wound dressing packages. In other alternative implementations, the wound dressing packages can be any type, size, or shape, and can be any material. For example, instead of or in addition to pouches, the individual packages can be individual boxes, individual bags, individual envelopes, etc.

The box 10 has printed information on one or more of its surfaces. For example, the box 10 includes directions, usage information, and ingredient information on its front surface 14. In alternative implementations, the printed information can be on any surface of the box 10 and can include any other information, including product classification information. The classification information can be used to easily identify the type of wound care product and its applications.

In the implementation illustrated in FIG. 1, each pouch 12 is made from a couple of sheets that are affixed to each other along each edge to preserve, prior to usage, a single wound dressing. The sheets can be made of any material, including polypropylene, plastic, foil, paper, etc. To remove the wound dressing, a wound care professional generally peels apart the sheet along a removably affixed edge 16.

The wound dressing, or similar wound care products, is used to maintain an optimal level of moisture, can be impregnated with various wound care products, can have ingredients that are absorptive, etc. For example, the wound dressings can be used to treat severe wounds, including chronic wounds such as pressure sores, diabetic foot ulcers, arterial ulcers, etc. The wound dressing can be, for example, a silver antimicrobial wound dressing, a silver antimicrobial barrier wound dressing, a non-adhesive foam wound dressing, an adhesive foam wound dressing, and/or combinations thereof, etc. In more general examples, the wound care products can include any hydrogel, hydrogel with silver, hydrogel filler with silver, hydrogel sheet, hydrogel sheet with silver, hydrogel perforated sheet with silver, hydrogel barrier with silver, tape, transparent film, wound filler, foam, foam with silver, combinations thereof, etc. In more specific examples, the wound care products can be products known as DERMA-GEL™, TENDERWET™, SILVASORB™, AQUAFLO™, AQUASORB™, CARRADRESS CLEAR™, CLEARSITE™, or CURAGEL™ (all products being available from Medline Industries, Inc. located in Mundelein, Ill.). In alternative implementations, other types of wound care products (including other types of wound dressings) can be used for treating severe wounds.

Figure 2:
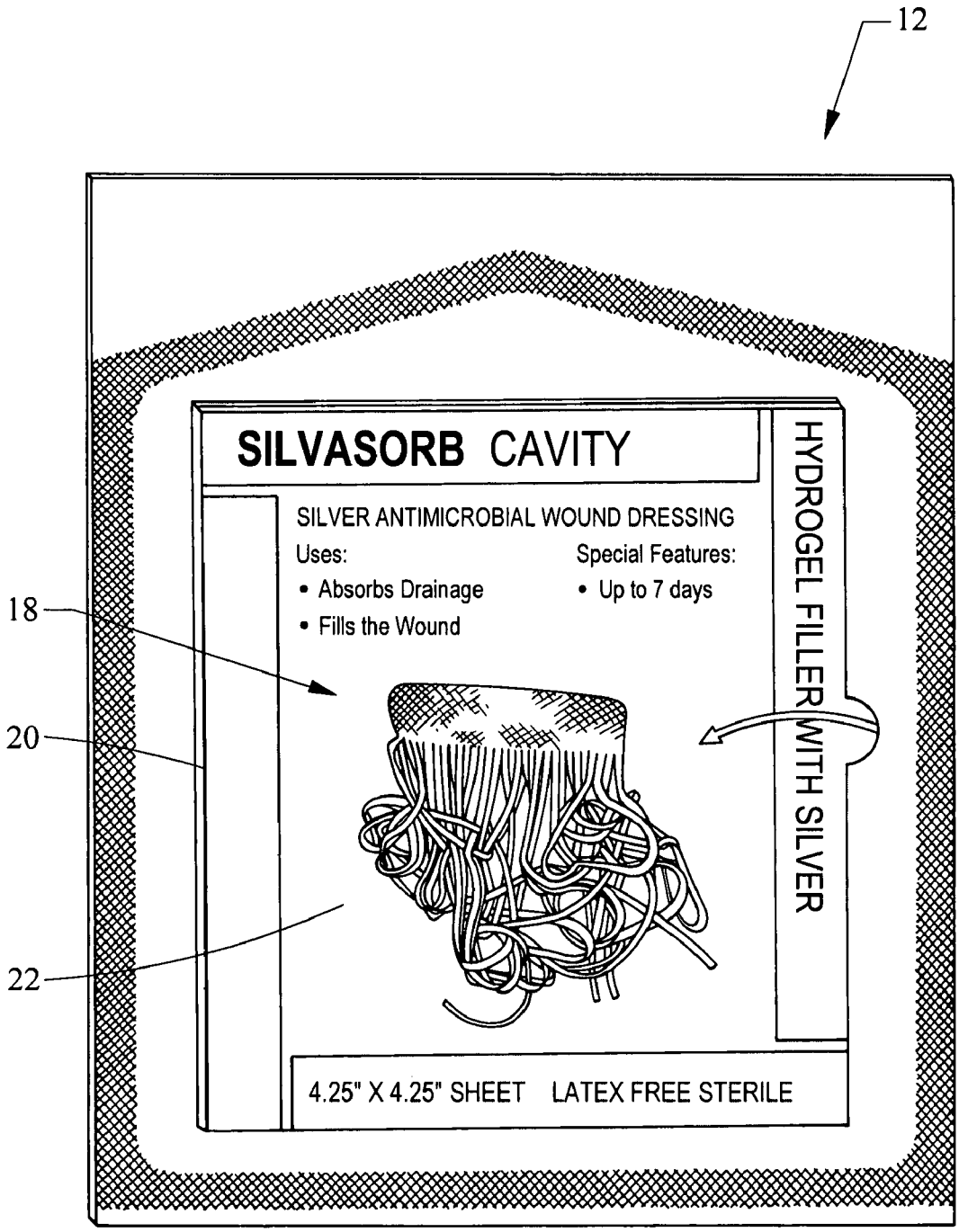
FIG. 2 illustrates a perspective view of one of the wound dressing pouches shown in FIG. 1.

Referring to FIG. 2, a main label 18 is attached to an exterior surface of the pouch 12. The main label 18 is generally a booklet-type label that includes two pages (or sheets), which are attached to each other along a single edge 20. On its cover 22, which is the exterior surface of a top one of the two pages, the main label 18 includes printed information (such as directions) related to the enclosed wound dressing. For example, if the wound dressing is a hydrogel filler with silver, the cover generally describes applicable uses (e.g., absorbs drainage, fills the wound) and wound dressing size (e.g., 4.25"×4.25" sheet). For this type of wound dressing, the cover 22 of the main label 18 can be opened, as indicated by the arrow, to reveal other information printed inside the main label 18.

The main label 18 provides useful information related to wound care products for treating severe wounds, such as wound dressings, in a clear and understandable form. The printed information is intended to bring clarity and understanding regarding the wound care product contained within the individual package to an end user, including a nurse, patient, and patient's family. As such, the printed information reduces (and hopefully, eliminates) confusion about the many types of products that a patient may require. For example, the printed information can help to educate an overworked nurse that may have limited knowledge on wound care and that is juggling many duties. Thus, the main label 18 makes it difficult for the end user, such as a healthcare worker, to make improper or incorrect use of the individually packaged wound care product. The main label 18 reduces costs associated with medical errors.

Figure 3:
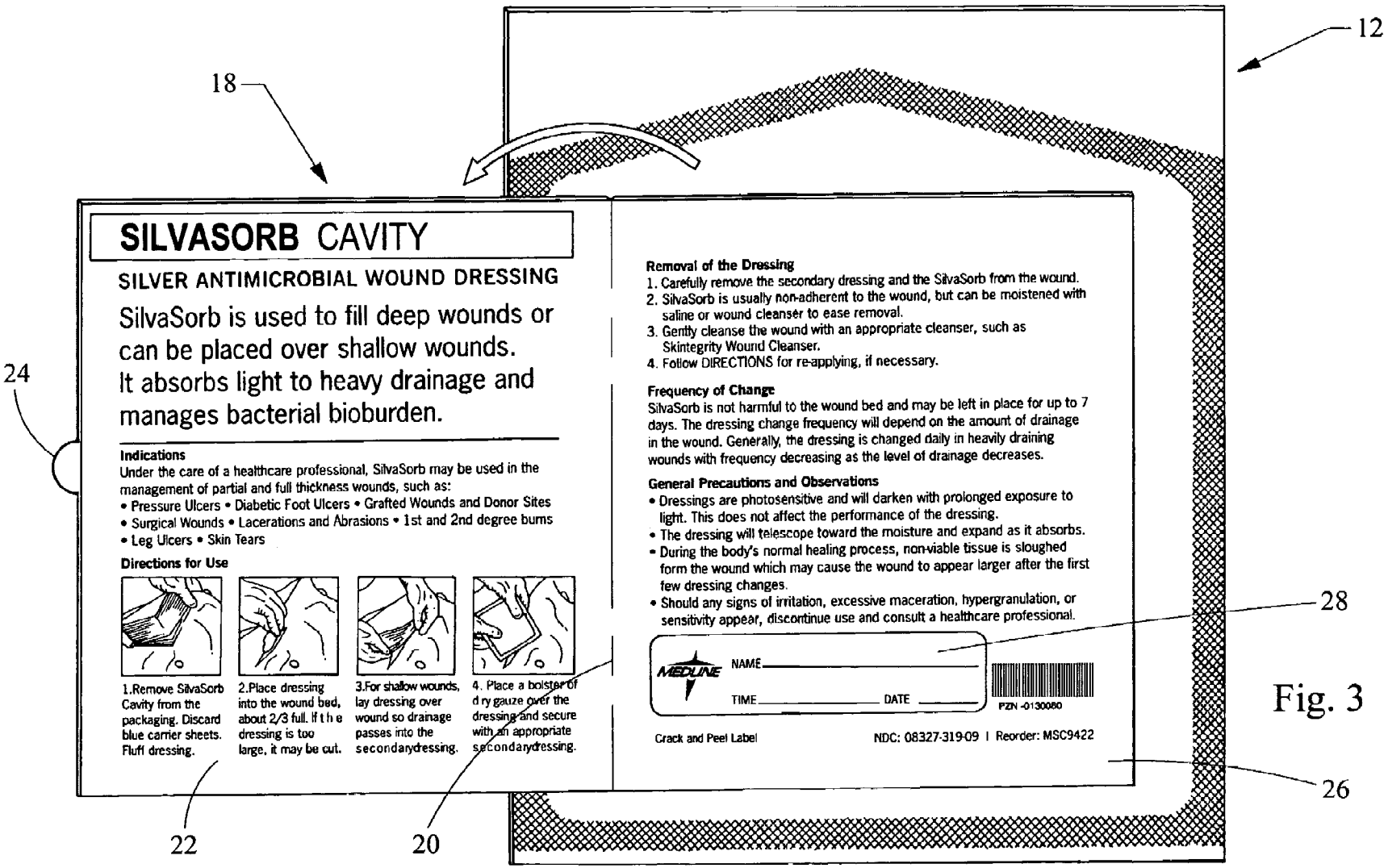
FIG. 3 illustrates the wound dressing pouch shown in FIG. 2 having its booklet label in an open position.

Referring to FIG. 3, the main label 18 has been opened and it shows additional information regarding wound dressing instructions, directions, usage, ingredients, and/or warnings. According to this implementation, the main label 18 can be opened by lifting a tab 24. The information is optionally printed on both interior sides of the main label 18. Specifically, the information can be printed on both the interior side of the top (or cover) page 22 and on the interior side of a bottom page 26. The printed information can be duplicative of information printed on the box 10 and, optionally, can include additional information.

According to an exemplary implementation, the information on the main label 18 can include photographic instructions. The photographic instructions can be used in addition to or instead of the printed information as described herein in reference to the wound dressing packages. Through the assistance of photography, such as explicit diagrams, drawings, and/or photographs, in conjunction with written textual instructions, even non-qualified users can safely use the enclosed wound care products. For example, any member of the patient's family, including English and non-English speaking members, should be able to follow the easy to use instructions by following the displayed diagrams.

A removable label 28 is attached to the interior surface of the bottom page 26 of the main label 18. The removable label 28 can be used on any type of wound dressing package described herein. The removable label 28 can be attached using any means, such as adhesive means or heat seal means. The removable label 28 includes a markable area for printing information related to the wound being treated. The printed information can be handwritten by the wound care treating person or it can be imprinted by a generally available printer machine. According to the illustrated implementation, the removable label 28 includes both preprinted information and blank areas for on-the-spot marking of patient-specific information. For example, the preprinted information can include a patient's "NAME," a "TIME" of dressing change, and/or a "DATE" of dressing change. Next to each piece of preprinted information, the treating person can easily mark any relevant wound information.

The removable label 28 can be a crack-and-peel label, a pre-perforated detachable label, etc. The removable label 28 can be located in any desirable location on main label 18. For example, in an alternative implementation the removable label 28 can be located along the edge of the cover of the main label 18 using a pre-perforated label. Optionally, the cover can include two adjacent pre-perforated labels that can be easily detached by the treating person.

Figure 4:
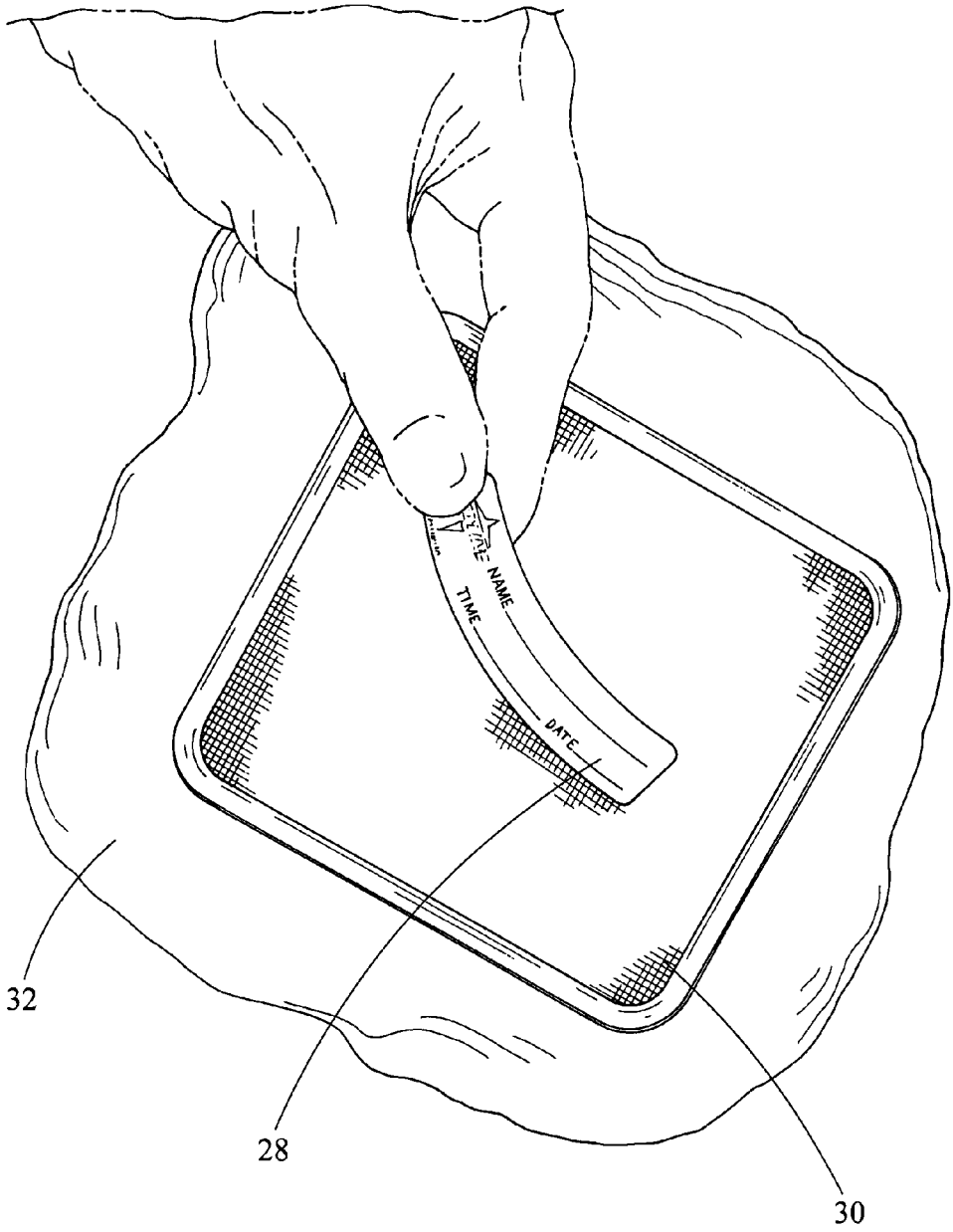
FIG. 4 illustrates a removable label of the booklet label shown in FIG. 3 located on a wound dressing.

Referring to FIG. 4, the removable label 28 is illustrated located on a wound dressing 30 on a patient wound 32. For example, a wound care professional first removes the wound dressing 30 from its respective pouch 12 and, then, places it on the wound 32. Subsequently, the wound care professional can place the removable label 28 directly on the wound dressing 30 to identify, for example, the specific time and date when the dressing change occurred. Other relevant information, such as special instructions, patient's age, patient's sex, etc., can be optionally marked on the removable label 28. The removable label 28 is useful in reducing the potential for human error when treating a wound, e.g., changing the wound dressing too soon or too late.

Figure 5:
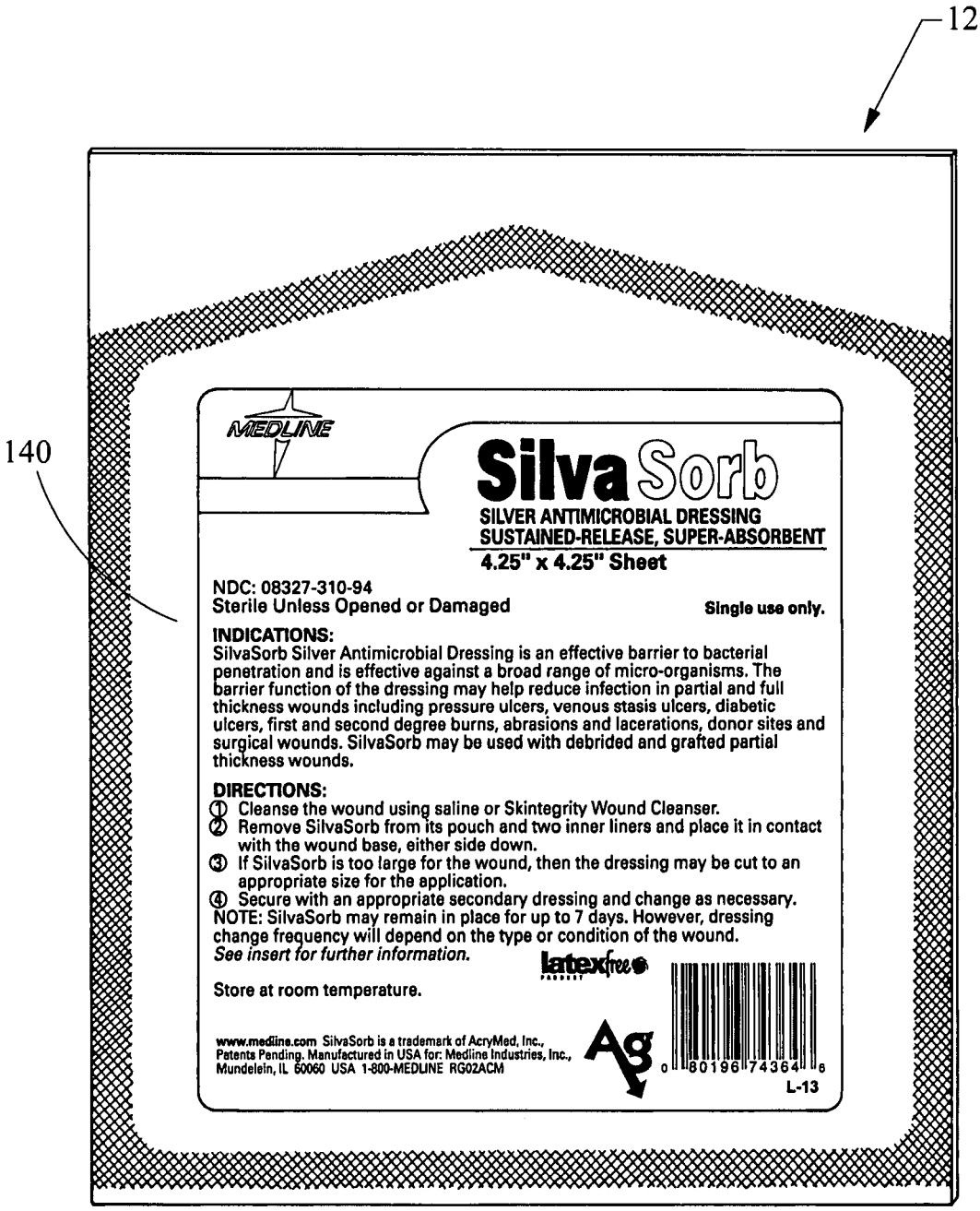
FIG. 5 illustrates the wound dressing pouch shown in FIG. 2 having a secondary label.

Referring to FIG. 5, a pouch 112 includes a secondary label 140 in accordance with an alternative implementation. In this implementation, the secondary label 140 is a sheet with directions and is initially obscured by a booklet label (not shown) similar to main label 18 described above in reference to FIGS. 1-4. While the booklet label can provide detailed information for the treating person, the booklet-type label may be deemed as being unnecessary for a number of reasons, e.g., to further reduce storage space. Thus, the booklet label can be removably attached to the pouch 112 for providing the treating person with great flexibility as to whether the booklet label should be preserved or discarded. To eliminate the potential for wound dressing misuse when the booklet label is discarded, the secondary label 140 is permanently affixed between the pouch 112 and the discarded booklet label. Due to minimal space availability, the secondary label 140 generally includes a shorter version of the information printed on the discarded booklet label. Another advantage of providing the secondary label 140 is to provide relevant information for the health care professional when the booklet label is inadvertently discarded. The secondary label 140 can be used with any wound dressing package described herein.

While the present invention has been described with reference to one or more particular embodiments, those skilled in the art will recognize that many changes may be made thereto without departing from the spirit and scope of the present invention. For example, in alternative embodiments the main label 18 can include multiple removable labels. The removable labels can be used to identify, for example, routine time periods during which the treating person has tended to the wound (e.g., a first removable label identifies that a routine wound check has been performed on the morning of day one, a second removable label identifies that a routine wound check has been performed on the evening of day two, etc.). According to other alternative implementations, the main label can include more than two pages using an accordion-style format where each page is attached along one edge to one adjacent page and along an opposite edge to another adjacent page. Any of the alternative embodiments can be used with any wound dressing package described herein. Each of these embodiments and obvious variations thereof is contemplated as falling within the spirit and scope of the invention, which is set forth in the following claims.

What is claimed is:

1. A wound care package comprising:

a wound care product for treating a severe wound and including at least one of a silver antimicrobial wound dressing, a silver antimicrobial barrier wound dressing, a non-adhesive foam wound dressing, an adhesive foam wound dressing, hydrogel with silver, a hydrogel filler with silver, a hydrogel sheet with silver, a hydrogel perforated sheet with silver, and a hydro gel barrier with silver, a foam, or a foam with silver;

an individual package in the form of a pouch in which the wound care product is stored prior to usage;

a booklet-type label affixed to an exterior surface of the individual package, the booklet-type label including on its interior surface severe wound treatment information;

at least one removable label attached to the booklet-type label, the removable label including a markable surface and one or more of a crack-and-peel label and a perforated label;

a secondary label having a set of directions for applying the wound care product, the secondary label being directly affixed to the exterior surface of the individual package, the booklet-type label being directly affixed to the secondary label such that the secondary label is obscured from view until the booklet-type label is removed to reveal the secondary label; and a box containing a plurality of individual packages, one of the plurality of individual packages being the individual package in which the wound care product is stored prior to usage, the box having usage information printed on at least one of its exterior surfaces, the usage information including product classification information for identifying the severe wound being treated.

2. A method for providing a severe wound care package, the method comprising:

inserting a wound care product into an individual package;

attaching a booklet-type label to an exterior surface of the individual package; and providing a set of usage directions for treating a severe wound, the set of usage directions being located on an interior surface of the booklet-type label and including photographic instructions;

removably attaching at least one removable label to the booklet-type label;

providing a markable area on the removable label;

inserting a plurality of individual packages in a box container, the plurality of individual packages including the individual package, the box container includes usage information printed on at least one of its exterior surfaces;

attaching a sheet of directions in direct contact with an exterior surface of the individual package; and removably attaching the booklet-type label in direct contact with the sheet of directions, the sheet of directions being obscured from view until the booklet-type label is removed.

3. A wound dressing package for treatment of a severe wound, the wound dressing package comprising:

a container;

a plurality of individual pouches located inside the container;

a wound dressing located inside each of the plurality of individual pouches;

a main label attached to an exterior surface of each of the plurality of individual pouches, the main label including a top sheet and a bottom sheet connected to each other along one edge, the main label including severe wound treatment information on an interior surface of the bottom sheet;

a removable label located on the main label, the removable label including a user markable area; and a secondary label located between the main label and the exterior surface of a respective pouch of the plurality of individual pouches, the secondary label being completely obscured by the main label and including an abbreviated version of the severe wound treatment information of the main label;

wherein the main label is removably attached to the exterior surface of each of the plurality of individual pouches, the secondary label being revealed upon removal of the main label.

* * * * *